US008975990B2

(12) United States Patent
Godesa

(10) Patent No.: US 8,975,990 B2
(45) Date of Patent: Mar. 10, 2015

(54) SWITCHING MECHANISM FOR AN ELECTRICAL SWITCHING DEVICE AND AN ELECTRICAL SWITCHING DEVICE

(71) Applicant: Ludvik Godesa, Berlin (DE)

(72) Inventor: Ludvik Godesa, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 291 days.

(21) Appl. No.: 13/681,523

(22) Filed: Nov. 20, 2012

(65) Prior Publication Data

US 2013/0126319 A1 May 23, 2013

(30) Foreign Application Priority Data

Nov. 22, 2011 (DE) ..... 10 2011 086 834

(51) Int. Cl.

| | |
|---|---|
| ***H01H 9/20*** | (2006.01) |
| ***H01H 21/50*** | (2006.01) |
| ***H01H 71/50*** | (2006.01) |
| ***H01H 71/52*** | (2006.01) |

(52) U.S. Cl.

CPC ..... *H01H 21/50* (2013.01); *H01H 71/505* (2013.01); *H01H 71/525* (2013.01)

USPC ..... 335/167; 335/168; 335/171; 335/172; 200/400; 200/401

(58) Field of Classification Search

USPC ..... 335/167, 168, 171, 172; 200/400, 401

See application file for complete search history.

(56) References Cited

U.S. PATENT DOCUMENTS 5,300,907 A 4/1994 Nereau et al.

FOREIGN PATENT DOCUMENTS

| | | |
|---|---|---|
| DE | 69306822 T2 | 5/1997 |
| DE | 69306822 T2 | 5/1997 |
| EP | 0555158 A1 | 8/1993 |
| EP | 0555158 A1 | 8/1993 |
| WO | WO 9417545 A1 | 8/1994 |

OTHER PUBLICATIONS

Priority Document German Application No. DE 102011086834.8 filed Nov. 22, 2011.

*Primary Examiner* — Ramon Barrera

(74) *Attorney, Agent, or Firm* — Harness, Dickey & Pierce, P.L.C.

(57) ABSTRACT

An switching mechanism is disclosed for an electrical switching device. In at least one embodiment, the switching mechanism is for a low-voltage circuit-breaker. Further, an electrical switching device is disclosed, in particular a low-voltage circuit-breaker, with a switching mechanism.

19 Claims, 11 Drawing Sheets

SWITCHING MECHANISM FOR AN ELECTRICAL SWITCHING DEVICE AND AN ELECTRICAL SWITCHING DEVICE

PRIORITY STATEMENT

The present application hereby claims priority under 35 U.S.C. §119 to German patent application number DE 10 2011 086 filed Nov. 22, 2011, the entire contents of which are hereby incorporated herein by reference.

FIELD

At least one embodiment of the 6invention generally relates to a switching mechanism for an electrical switching device, in particular for a low-voltage circuit-breaker, as well as an electrical switching device, in particular a low-voltage circuit-breaker, with a switching mechanism. At least one embodiment of the invention generally relates to electrical switching devices, in particular to circuit-breakers in the low-voltage range.

BACKGROUND

"Low-voltage" typically refers to voltages of up to approx. 1000 Volt. If the switching isolating distances are designed accordingly, such switching devices can also be designed for switching voltages above 1000 Volt, e.g. up to 6.3 kV. In particular electrical switching devices of this type, such as low-voltage circuit-breakers, are designed to interrupt current paths in the event of an overcurrent or a short-circuit. They can be embodied as single-pole or multi-pole, in particular three-pole.

A switching mechanism for a low-voltage circuit-breaker is known from European patent application EP 0 555 158 A1. It has a movable contact, the manual opening and closing of which, as well as automatic opening because of a fault, such as a short-circuit, is controlled via the switching mechanism. The switching mechanism furthermore has a latch, articulated on a fixed spindle and having a cam surface. The switching mechanism further comprises a toggle formed by a toggle spindle, a lever linked on the one hand to the movable contact and on the other hand to the toggle spindle, as well as a lever articulated on the one hand on the latch and on the other hand on the toggle spindle. The switching mechanism further has a spring attached on the one hand to the toggle spindle and on the other hand to a handle for opening and closing the contacts.

The switching mechanism comprises a lock designed to cooperate with the latch to hold the latter in the locked position. It further comprises a cam-follower roller actuated by the handle and designed to cooperate with the cam surface of the latch to move the latch to the locked position, the handle being able to move to three distinct positions: a closed position in which the spring urges the toggle to an extension position, a manual opening and resetting position where the spring urges the toggle to a broken position wherein the latch is in the locked position, and a tripped position in which the latch is unlocked and the toggle broken. The cam surface comprises a slope change point marking the limit between two successive sections, a first section corresponding approximately to the travel of the handle between the tripped position and the reset position, and a second section corresponding to the reset position, the slope of the first section being such that the resultant of the forces derived from the spring and exerted on the handle urges the handle to the tripped position, and the slope of the second section being such that the handle is urged to the reset position arranged as a stable position holding the latch.

The disadvantage of such a switching mechanism for an electrical switching device is that can result in an undesired tripping of the switching mechanism if the latch is in the locked position and the handle is in the open position. In the case of improper transport of the electrical switching device the result can be that a tripping mechanism of the electrical switching device acts on the lock such that the latch leaves its locked position and thus trips the electrical switching device.

DE 693 06 822 D2 discloses a switching mechanism for a circuit-breaker. In this switching mechanism the handle and the latch can be held in the loaded position in the event of unwanted tripping. The switching mechanism is here characterized in that a cam surface of the latch has a slope change point marking the limit between two successive sections, a first section corresponding approximately to the travel of the handle between the tripped position and the reset position, and a second section corresponding to the reset position, the slope of the first section being such that the resultant of the forces derived from the spring and exerted on the handle urges the handle to the tripped position, and the slope of the second section being such that the handle is urged to the reset position arranged as a stable position holding the latch. Thanks to the profile of the cam surface the reset position of the handle becomes a stable position in which the handle holds the latch regardless of the position of the lock. Although a tripping action of a tripping mechanism which releases the lock cannot be prevented, this has no effect, since the latch is held by the handle. In this way any risk of the tripping and locking system being destroyed, which could occur if these systems are mechanically blocked to prevent an undesired release action, is excluded.

SUMMARY

At least one embodiment of the invention is directed to a switching mechanism for an electrical switching device, in which a latch and a latching element of the switching mechanism can be held securely in a loaded position if the operating lever of the electrical switching device is in an OFF position. The loaded position should in particular be held if, for example because of external influences, the tripping mechanism of the electrical switching device is at least partially actuated.

At least one embodiment of the invention is directed to a switching mechanism for an electrical switching device and/or an electrical switching device. Further features and details of the invention emerge from the subclaims, the description and the attached drawings. Features which are described in connection with embodiments of the inventive switching mechanism of course also apply in connection with embodiments of the inventive electrical switching device and vice versa in each case, so that reference is or can always be reciprocally made to the individual aspects of embodiments of the invention in respect of the disclosure.

According to a first aspect of an embodiment of the invention, a switching mechanism is disclosed for an electrical switching device, in particular for a low-voltage circuit-breaker, having an articulated mechanism for moving a movable contact, an operating lever for manually opening and closing the movable contact via the articulated mechanism, wherein the operating lever has a grip and a terminal link which can be pivoted about a fixed bearing point, a latch mounted so as to rotate about a fixed latch spindle and having a clamping cam, the latch having an end cooperating with a latching element of the switching mechanism for latching and unlatching the latch at the latching element, wherein the latch is in operative contact with the movable contact in order to move the latter via the articulated mechanism, a tensioning roller which can be driven via the operating lever such that when the operating lever is moved the tensioning roller is in operative contact with the latch because it rolls along the clamping cam of the latch, a tensioning element for clamping the operating lever, a tripping mechanism which to move the latching element can be brought into operative contact therewith, as well as a force element which is disposed between the latching element and the tripping mechanism and presses these apart from one another, wherein the force element exerts a force on the latching element in the direction of the end of the latch.

According to a second aspect of an embodiment of the invention, an electrical switching device, in particular a low-voltage circuit-breaker, includes at least one movable contact and at least one fixed contact as well as a switching mechanism for connecting and separating the at least one movable contact and the at least one fixed contact, wherein the switching mechanism is designed according to the first aspect of an embodiment of the invention. Such an electrical switching device, such as a low-voltage circuit-breaker, accordingly has the same advantages as have been fully explained according to the first aspect for the switching mechanism.

BRIEF DESCRIPTION OF THE DRAWINGS

Embodiments of the invention is explained in greater detail below with reference to the attached figures. The drawings schematically show.

Elements with an identical function and effect are provided with the same reference characters in FIGS. 1 to 11 in each case.

DETAILED DESCRIPTION OF THE EXAMPLE EMBODIMENTS

Figure 1:
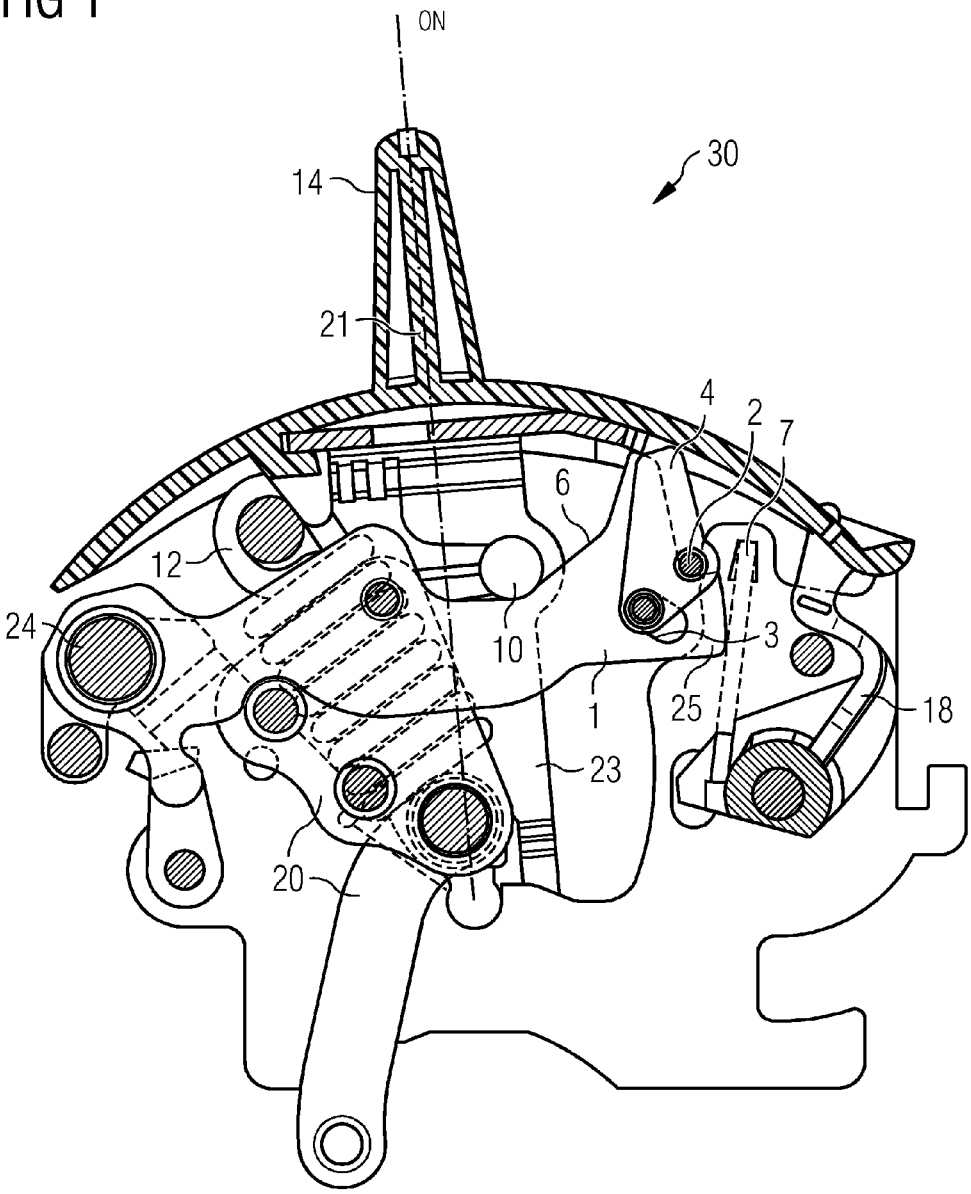
FIG. 1 a switching mechanism of an electrical switching device which is designed according to an embodiment of the inventive design principle, wherein the operating lever of the switching device is in an ON position, FIG. 2 the switching mechanism according to FIG. 1 showing the force element between the latching element and the tripping mechanism of the switching mechanism, FIG. 3 the switching mechanism according to FIG. 1 during the tensioning operation, FIG. 4 the switching mechanism according to FIG. 1 at the end of the tensioning operation, FIG. 5 the contacting of the tensioning roller on the rotary element of the switching mechanism during the tensioning operation, FIG. 6 an enlarged illustration of the tensioning roller as well as of the clamping cam of the latch and of the rotary element, FIG. 7 the switching mechanism according to FIG. 1 in the loaded position, wherein the operating lever is held in the OFF position, FIG. 8 an enlarged illustration of the rotary element, of the latching element and of the tripping mechanism in the loaded position of the switching mechanism, FIG. 9 the switching mechanism according to FIG. 1 during the switch-on operation of the operating lever, FIG. 10 a perspective illustration of a part of a switching mechanism which is designed according to an embodiment of the inventive design principle, and FIG. 11 another perspective illustration of the switching mechanism according to FIG. 10 showing the operating lever.

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

According to a first aspect of an embodiment of the invention, a switching mechanism is disclosed for an electrical switching device, in particular for a low-voltage circuit-breaker, having an articulated mechanism for moving a movable contact, an operating lever for manually opening and closing the movable contact via the articulated mechanism, wherein the operating lever has a grip and a terminal link which can be pivoted about a fixed bearing point, a latch mounted so as to rotate about a fixed latch spindle and having a clamping cam, the latch having an end cooperating with a latching element of the switching mechanism for latching and unlatching the latch at the latching element, wherein the latch is in operative contact with the movable contact in order to move the latter via the articulated mechanism, a tensioning roller which can be driven via the operating lever such that when the operating lever is moved the tensioning roller is in operative contact with the latch because it rolls along the clamping cam of the latch, a tensioning element for clamping the operating lever, a tripping mechanism which to move the latching element can be brought into operative contact therewith, as well as a force element which is disposed between the latching element and the tripping mechanism and presses these apart from one another, wherein the force element exerts a force on the latching element in the direction of the end of the latch.

The latch of an embodiment of the switching mechanism includes a bearing and a sliding block guide, that a rotary element is mounted on the bearing and is guided along the sliding block guide, wherein the rotary movement of the rotary element is restricted by the sliding block guide, that the rotary element is designed such that it can be brought into operative contact firstly with the tensioning roller and secondly with the latching element and that on conclusion of a tensioning operation of the operating lever it holds the latch and the latching element in a loaded position. Furthermore, the latch, the rotary element and the latching element are designed such that during the tensioning operation of the operating lever the latching element is inserted into a recess of the latching element, so that the latching element can move in the direction of the end of the latch and away from the tripping mechanism, so that in the loaded position a gap exists between the latching element and the tripping mechanism.

A switching mechanism designed in this way for an electrical switching device, in particular for a low-voltage circuit-breaker, enables the latch and the latching element to remain in the loaded position in the event of undesired tripping, if the operating lever in the OFF position. In the loaded position of the latch and of the latching element a gap exists between the latching element and the tripping mechanism, so that in the event of an undesired tripping operation the tripping mechanism cannot touch the latching element and the latch and the latching element remain in the loaded position. Thanks to this embodiment of the switching mechanism the loaded position of the latch and of the latching element becomes a stable position, in which undesired tripping, for example as a result of a blow to the electrical switching device, can be prevented. This means that although a tripping action in which the tripping mechanism is moved cannot be prevented, it has no effect, since because of the gap between the latching element and the tripping mechanism the tripping mechanism does not touch the latching element. As a result the risk of damage to the switching mechanism of the electrical switching device can be prevented.

A switching mechanism designed in this way for an electrical switching device enables the latch and the latching element to be held in the loaded position if the operating lever of the switching mechanism is in the OFF position. Positioning the switching mechanism in this way is in particular desirable if electrical switching devices are supplied by the manufacturer to a customer. The customer can, by manually moving the operating lever from the OFF position to an ON position, bring the trip mechanism back into operative contact with the latching element, so that the electrical switching device can, when connected to a supply voltage network, securely protect a consumer in the event of a fault.

By way of the articulated mechanism at least one movable contact of the switching mechanism can be moved. This at least one movable contact can be brought into contact with at least one fixed contact of the electrical switching device, so that a flow of current through the electrical switching device is enabled. To interrupt the flow of current the movable contact can be separated from the fixed contact by way of the articulated mechanism. The operating lever of the switching mechanism is in operative contact with the articulated mechanism. The operating lever has a terminal link which can be pivoted about a fixed bearing point, as well as a grip. The grip can be gripped by a user of the electrical switching device in order to switch the operating lever manually between an OFF and an ON position.

The latch of the switching mechanism is in operative connection with the movable contact to move the movable contact via the articulated mechanism. The latch is rotatably mounted about a fixed latch spindle. In this case the latch spindle can be disposed at one end of the latch or else in the center or close to the center of the latch. The latch has an end cooperating with the latching element of the switching mechanism. The latch can be latched to the latching element via this end. This means that in the latched state, known as the loaded position, the end of the latch abuts the latching element and is held thereby. In the unlatched state the latching element releases the movement of the latch, so that because of the forces acting on it it is rotated about the fixed latch spindle.

The latch further has a clamping cam. The clamping cam itself is formed by the contour of the latch on one side. Abutting this clamping cam of the latch is a tensioning roller which can be driven via the operating lever such that in the event of a movement of the operating lever the tensioning roller rolls along the clamping cam of the latch and thereby swivels it. Advantageously the tensioning roller is disposed rotatably movably on the operating lever, in particular the rocker terminal link of the operating lever. If the latch moves as a result of the tensioning roller rolling on the clamping cam of the latch the tensioning element of the switching mechanism is tensioned or released. This means that depending on the direction in which the tensioning roller rolls along the clamping cam of the latch, the tensioning element is tensioned or released. In the loaded position of the latch and of the latching element the tensioning element is tensioned, so that when the latch is unlatched from the latching element it moves the latch back into its released position. The tensioning element is hence in operative contact with the latch.

The tripping mechanism of the switching mechanism can be brought into operative contact therewith for moving the latching element. In this case the tripping mechanism is moved mechanically. A force element is disposed between the tripping mechanism and the latching element, and presses both elements away from one another. This means that the force element exerts a force on the latching element in the direction of the end of the latch.

Advantageously provision is made in the switching mechanism for a rotary element which is mounted at a bearing of the latch and additionally is guided along a sliding block guide of the latch. By mounting and guiding the rotary element at the bearing or inside the sliding block guide, the rotary movement of the rotary element relative to the latch is restricted or predefined. In this case the rotary element is designed such that it can be brought into operative contact firstly with the tensioning roller and secondly with the latching element. This means that during a rolling operation of the tensioning roller along the clamping cam of the latch the tensioning roller comes into contact with the rotary element and rotates this relative to latch. Thanks to the pivoting movement of the latch and the shape of the rotary element, the rotary element can furthermore come into operative contact with the latching element.

On conclusion of the tensioning operation of the operating lever, the rotary element holds the latch and the latching element in a loaded position. In this case the latch, the rotary element and the latching element are designed and aligned with one another such that during the tensioning operation of the operating lever the rotary element is inserted into a recess of the latching element, so that the latching element can move in the direction of the end of the latch and away from the tripping mechanism, so that in the loaded position a gap arises between the latching element and the tripping mechanism. In other words, the rotary element is first guided along the latching element during the tensioning operation of the latch.

As soon as the rotary element reaches the recess of the latching element, the latching element moves, because of the pretensioning which the force element exerts on the latching element, in the direction of the end of the latch, as a result of which the latching element moves away from the tripping mechanism of the switching mechanism and the gap arises. Insertion of the rotary element means, in the context of an embodiment of the invention, that the rotary element is inserted into the recess of the latching element not actively, through its own motion in the direction of the latching element, but passively, namely by a movement of the latching element in the direction of the rotary element or of the end of the latch. In this case the latching element slides along the rotary element or the contour of the rotary element because of the force acting on it.

During the tensioning operation of the electrical switching device, i.e. the movement of the operating lever from "TRIP" to "RESET", the tensioning roller presses the rotary element away or rotates the rotary element. In this case the rotary element is designed such that on reaching the loaded position the tensioning roller releases the rotary element, so that this jumps back into its original position under the effect of the force of the latching element.

In the original position of the rotary element the rotary element overlaps the clamping cam of the latch. In the loaded position of the latch the rotary element is held in the original position because of the force acting on the latching element. In this case the rotary element, the latch and the latching element are aligned with one another such that after release of the operating lever or the grip of the operating lever the rotary element holds the tensioning roller and thus the latch in the loaded position. This means that if the grip of the operating lever is released, the tensioning roller remains under pressure on the rotary element or a keep-out area of the rotary element.

In this case the rotary element is in its original position, in which it overlaps the clamping cam of the latch. The rotary element or the keep-out area on the rotary element is designed such that the forces acting in the whole switching mechanism are in equilibrium if the tensioning roller abuts the rotary element, as a result of which the grip or the operating lever necessarily remains in this position. In this loaded position the tripping mechanism can be actuated without a tripping operation being performed on account of a movement of the latch. Because of the gap present in the loaded position between the latching element and the tripping mechanism no pressure can be exerted by the tripping mechanism on the latching element.

In the loaded position the rotary element holds the operating lever in its OFF position. This ensures that the switching mechanism of the electrical switching device, in particular the contacts of the electrical switching device, are not damaged, for example during transport of the electrical switching device.

In this case the switching mechanism of the electrical switching device is designed such that in the event of a movement of the operating lever from the OFF position to the ON position, triggered by a manual actuation of the grip of the operating lever by a user, the tensioning roller is separated from the rotary element, as a result of which the latch can be swiveled under the effect of the tensioning element. This pivoting movement of the latch is however restricted by the latch touching the latching element. This means that after transferring the operating lever from the OFF position to the ON position, known as the switch-on operation of the electrical switching device, the latching element is in operative contact with both the end of the latch and the tripping mechanism.

In the ON position of the operating lever the latching element directly abuts the tripping mechanism, so that the latter, in the event of a movement of the tripping mechanism, can release the latching between the latching element and the latch, so that the electrical switching device can perform a tripping operation, in which because of a movement of the latch the movable contact separates from the fixed contact of the electrical switching device and thereby the flow of current to a consumer is interrupted by the electrical switching device.

According to a preferred development of an embodiment of the invention provision can be made in the case of a switching mechanism for the rotary element to have a keep-out area and for the tensioning roller to abut the keep-out area in the loaded position of the latch and of the latching element. The rotary element can be designed in various ways.

In this case the rotary element is advantageously disposed on the bearing and the sliding block guide of the latch such that it can be guided along the latch and parallel to it. The keep-out area of the rotary element is formed by the part of the rotary element which overlaps the clamping cam of the latch in the original position of the rotary element. The keep-out area of the rotary element is here designed such that the forces, i.e. friction forces, between the tensioning roller and the keep-out area as well as forces that the tensioning element exerts on the latch, are kept in equilibrium if the tensioning roller abuts the keep-out area under pressure.

By the tensioning roller abutting the keep-out area of the rotary element the operating lever remains stationary. In this position, i.e. the loaded position of the latch and the OFF position of the operating lever, the switching mechanism freezes. The keep-out area of the rotary element is in particular designed such that it prevents the tensioning roller rolling along the clamping cam of the latch, counter to the force of the tensioning element acting on the latch.

Advantageously the rotary element is designed and is held on the bearing and the sliding block guide such that on conclusion of the tensioning operation of the operating lever at least the keep-out area of the rotary element overlaps the clamping cam of the latch for the tensioning roller to abut the keep-out area. The keep-out area of the rotary element advantageously has a level or an approximately level shape. This ensures that there is sufficient friction between the tensioning roller and the keep-out area of the rotary element in the loaded position of the latch.

Particularly advantageous is a switching mechanism, in which the rotary element is in operative contact with the latching element such that on conclusion of the tensioning operation of the operating lever, i.e. a movement of the latch because of a manual movement of the operating lever, the latching element presses the rotary element into an original position in which at least the keep-out area of the rotary element overlaps the clamping cam of the latch for abutting the tensioning roller. This means that as soon as, during the tensioning operation of the operating lever and thus of the latch, the tensioning roller which initially swiveled the rotary element out of its original position loses the contact with the rotary element, the rotary element jumps back to its original position under the effect of the force of the latching element, so that in the case of a reverse movement of the tensioning roller along the clamping cam of the latch the tensioning roller comes to a stop on the rotary element or on the keep-out area because of the equilibrium of the prevailing forces. This means that after release of the grip of the operating lever the tensioning roller moves back again on the clamping cam of the latch, under the effect of the tensioning element, and remains on the keep-out area of the rotary element under pressure.

According to another preferred development of an embodiment of the invention, provision can be made in the case of a switching mechanism for a force of the tensioning element to be applied to the operating lever such that on conclusion of the tensioning operation of the operating lever and a subsequent release of the operating lever the tensioning roller can, under the effect of the tensioning element, roll along the clamping cam of the latch until it abuts the keep-out area of the rotary element in equilibrium of the operative forces in the switching mechanism. This means that the friction forces arising at the keep-out area between the tensioning roller and the rotary element counter the force of the tensioning element exerted on the latch such that when the tensioning roller contacts the keep-out area of the rotary element the rotary element holds the grip or the operating lever in the OFF position and the latch and the latching element are tensioned.

The latch has both a bearing and a sliding block guide for the rotary element, to guide this relative to the latch. In this case the bearing can be disposed on or in the end of the latch facing the latching element. Preferably the bearing is formed by a bending or a relief cut at the end of the latch. The sliding block guide in which the rotary element is additionally mounted permits only a particular movement of the rotary element relative to the latch. In this case the sliding block guide, the bearing and the rotary element are designed such that with the rotary element in its original position at least its keep-out area overlaps the clamping cam of the latch. In this original position of the rotary element the rotary element or a bolt of the rotary element strikes against an end of the sliding block guide. The sliding block guide can be designed in a variety of ways. Preferably the sliding block guide is designed as a bent slot in the end of the latch facing the latching element.

The rotary element advantageously has a concentric contour about its axis of rotation, which functions as a roller during the tripping operation. At the end of the tensioning operation the latching element or an edge on the recess of the latching element slides along the concentric contour of the rotary element. Thanks to this latching or type of latching, good start-up security is ensured with low tripping forces.

The rotary element itself can be designed in a variety of ways. Thus the rotary element can be movably guided on one side of the latch, parallel or approximately parallel to the latch. Advantageously the rotary element has a level base body which is guidably held by a bolt on the bearing of the latch and by another bolt in the sliding block guide of the latch. The two bolts advantageously project out of the base body of the rotary element and perpendicular thereto. Alternatively the rotary element can have a knife-edge bearing.

According to an alternative preferred development of an embodiment of the invention provision can be made in the case of a switching mechanism for a rotary element to be provided with two base bodies, wherein a first base body is movably disposed on a first side of the latch and the second base body on the other side of the latch. The two base bodies of the rotary element are guided by two bolts which are mounted in the sliding block guide and on the bearing of the latch. It is also conceivable for a switching mechanism to be provided with two completely separate rotary elements. Advantageously the latch is disposed between the two rotary elements.

According to another preferred development of an embodiment of the invention provision can be made in the case of an alternative switching mechanism for two latches to be provided, between which a rotary element is movably disposed.

The tensioning element for tensioning the operating lever of the switching mechanism can be designed in a variety of ways. Advantageously the tensioning element is designed as a spring element, in particular as a tension spring or compression spring. Other types of spring element, for example a leg spring, are also conceivable as a tensioning element. Provision is further advantageously made in the case of a switching mechanism for the force element disposed between the latching element and the tripping mechanism of the switching mechanism to be designed as a spring element. Advantageously this spring element is designed as a leg spring. However, it is also conceivable for the force element to be designed as a spiral spring, in particular as a tension spring or compression spring.

The rotary element of the switching mechanism can be designed as a stamped part or as a plate bending part. In this case the rotary element can be made of metal or of plastic.

The articulated mechanism disposed between the movable contact and the latch in order, in the event of a movement of the latch, to move the movable contact such that it can be brought into connection with a fixed contact of the electrical switching device or can be released therefrom, can be designed as a toggle.

The latching element is preferably designed such that it has a surface, along which the end of the latch facing the latching element as well as the rotary element, in particular the concentric contour of the rotary element, can run during a tensioning operation of the switching mechanism, and has a recess into which the rotary element can be inserted at the end of the tensioning operation. Preferably the latching element has a plate which is U-shaped.

The tripping mechanism of the switching mechanism can be designed in a variety of ways. A switching mechanism in which the tripping mechanism has a tripping shaft is preferable. A tripping operation of the electrical switching device can be triggered by movement of the tripping mechanism or of the tripping shaft, so that the movable contact is separated from the fixed contact of the electrical switching device. If the latch and the latching element are in the loaded position and the operating lever is in the OFF position, the tripping shaft is separated from the latching element by a gap. As a result a movement of the tripping shaft cannot result in a tripping operation of the electrical switching device, since no pressure can be exerted on the latching element via the tripping shaft. If the latch and the latching element are in the loaded position and the operating lever is in an ON position, the tripping shaft directly abuts the latching element, so that in the event of a movement of the tripping shaft, the tripping shaft moves the latching element, as a result of which the latching element releases the latching of the latch and a tripping operation is triggered. Instead of a tripping shaft a tripping latch, etc., can also be provided.

According to a second aspect of an embodiment of the invention, an electrical switching device, in particular a low-voltage circuit-breaker, includes at least one movable contact and at least one fixed contact as well as a switching mechanism for connecting and separating the at least one movable contact and the at least one fixed contact, wherein the switching mechanism is designed according to the first aspect of an embodiment of the invention. Such an electrical switching device, such as a low-voltage circuit-breaker, accordingly has the same advantages as have been fully explained according to the first aspect for the switching mechanism.

FIGS. 1 to 9 schematically show a switching mechanism 30 of an electrical switching device, in particular of a low-voltage circuit-breaker, which is designed according to an embodiment of the inventive design principle. The switching mechanism 30 has an articulated mechanism 20 for moving a movable contact (not shown). The articulated mechanism 20 can be designed as a toggle. The articulated mechanism 20 is in operative contact with a latch 1 of the switching mechanism 30. This means that the articulated mechanism 20 of the switching mechanism 30 is actuated by a movement of the latch 1, so that in a first position of the latch 1, known as the trip position of the latch 1, the articulated mechanism 20 is moved such that the movable contact coupled to the articulated mechanism 20 is separated from a fixed contact (likewise not shown) of the electrical switching device. In this state the electrical switching device disconnects a consumer from a voltage supply network. In a second position of the latch 1, known as the tensioned position GS, the articulated mechanism 20 is rotated by the latch 1 such that the movable contact contacts the fixed contact, so that the electrical switching device permits a flow of current to a consumer.

The latch 1 is rotatably mounted about a fixed latch spindle 24. In this case the latch spindle 24 can be disposed at an end of the latch 1, as shown in FIGS. 1 to 9. Alternatively it is possible for the latch spindle 24 to be disposed centrally or approximately centrally on the latch 1. The latch 1 further has a clamping cam 6. The switching mechanism 30 further has an operating lever 21 for manually opening and closing the movable contact via the articulated mechanism. The operating lever 21 has a grip 14 and a terminal link 23 which can be pivoted about a fixed bearing point. Provided on the operating lever 21 is a tensioning element 12, in particular in the form of a spring element, which in the event of a movement of the operating lever 21 and thus of the latch 1 is tensioned, so that it exerts a force on the latch 1. This means that the tensioning element 12 is disposed on the operating lever 21 and the latch 1 such that in the event of a movement of the operating lever 21 it is tensioned from an ON position to an OFF position and as a result exerts a force on the latch 1.

A tensioning roller 10, which can be driven via the operating lever 21, rolls along the clamping cam 6 of the latch 1 in the event of a movement of the operating lever 21. This means that the tensioning roller 10 is in continuous operative contact with the latch 1. In the position of the operating lever 21 shown in FIG. 1, i.e. in the ON position of the operating lever 21, the latch 1 is in an upper position, in which it is released. The tensioning roller 10 is rotatably movably attached to the terminal link 23 of the operating lever 21.

The latch 1 has an end 25 cooperating with a latching element 7 of the switching mechanism 30, which end is used for latching and unlatching the latch 1 on the latching element 7. In this case the latch 1 or the end 25 of the latch 1 can latch onto the latching element 7.

The switching mechanism 30 further has a tripping mechanism 18, in particular in the form of a tripping shaft, which in order to move the latching element 7 can be brought into operative contact therewith. Disposed between the latching element 7 and the tripping mechanism 18 is a force element 8, in particular in the form of a leg spring. The force element presses the tripping mechanism 18 and the latching element 7 apart, wherein the force element 8 applies a force in the direction of the end 25 of the latch 1 to the latching element 7.

The switching mechanism 30 further has a rotary element 4 which is movably held on a bearing 2 and on a sliding block guide 3 of the latch 1. In this case the rotary element 4 can be rotated about an axis of rotation on the bearing 2. During the rotary movement the rotary element 4 is guided in the sliding block guide 3. The sliding block guide 3 inside the latch 1 or inside the end 25 of the latch 1 here restricts the rotary movement of the rotary element 4. The rotary element 4 is designed such that it can be brought into operative contact firstly with the tensioning roller 10 and secondly with the latching element 7.

The latch 1 or the end 25 of the latch 1, the rotary element 4, the latching element 7 as well as the tensioning roller 10 cooperate during a tensioning operation of the latch 1.

Figure 2:
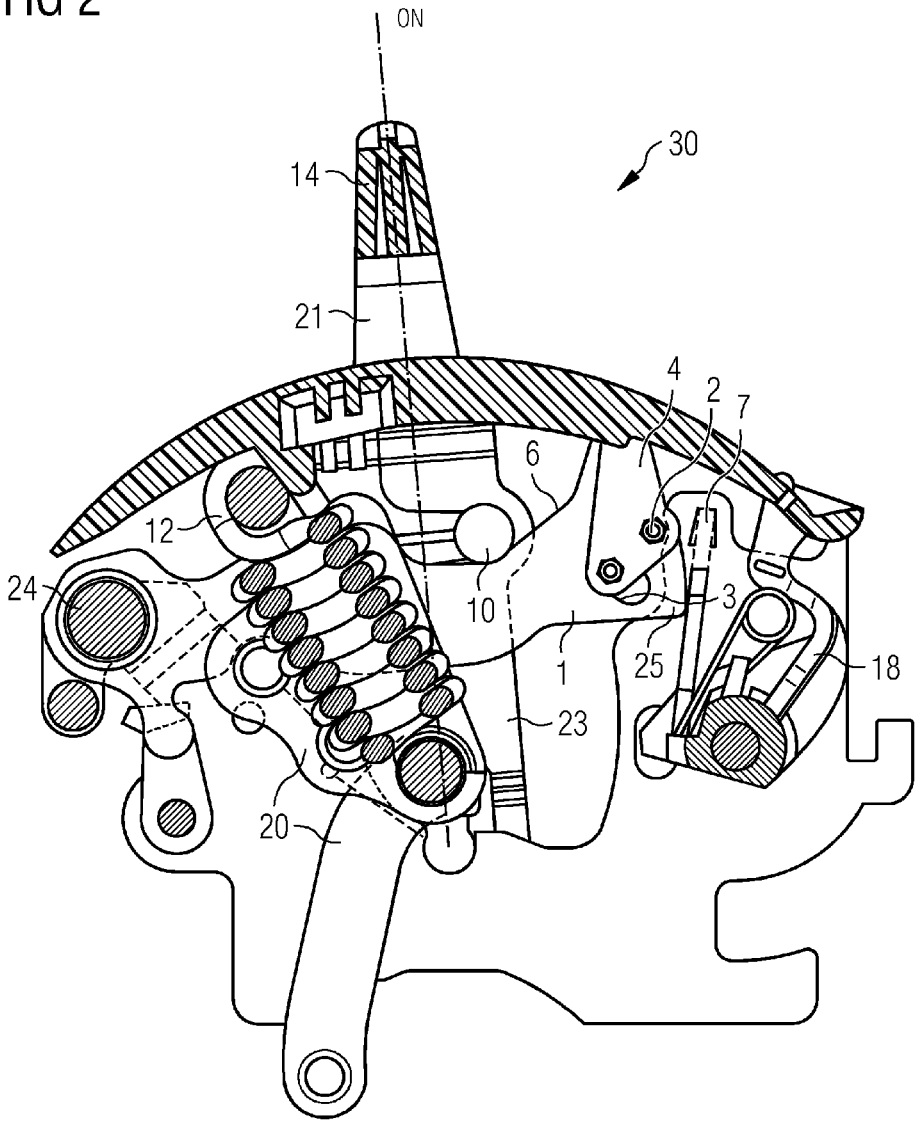

FIG. 2 shows the force element 8 which is disposed between the latching element 7 and the tripping mechanism 18. In this case the force element 8 presses the latching element 7 against the end 25 of the latch 1 or depending on the position of the latch 1 against the rotary element 4.

In the positions of the switching mechanism 30 shown in FIGS. 1 and 2 the force element 8 presses the latching element 7 against the latch 1 or against the end 25 of the latch 1. In this position the operating lever 21 is in an ON position.

Figure 3:
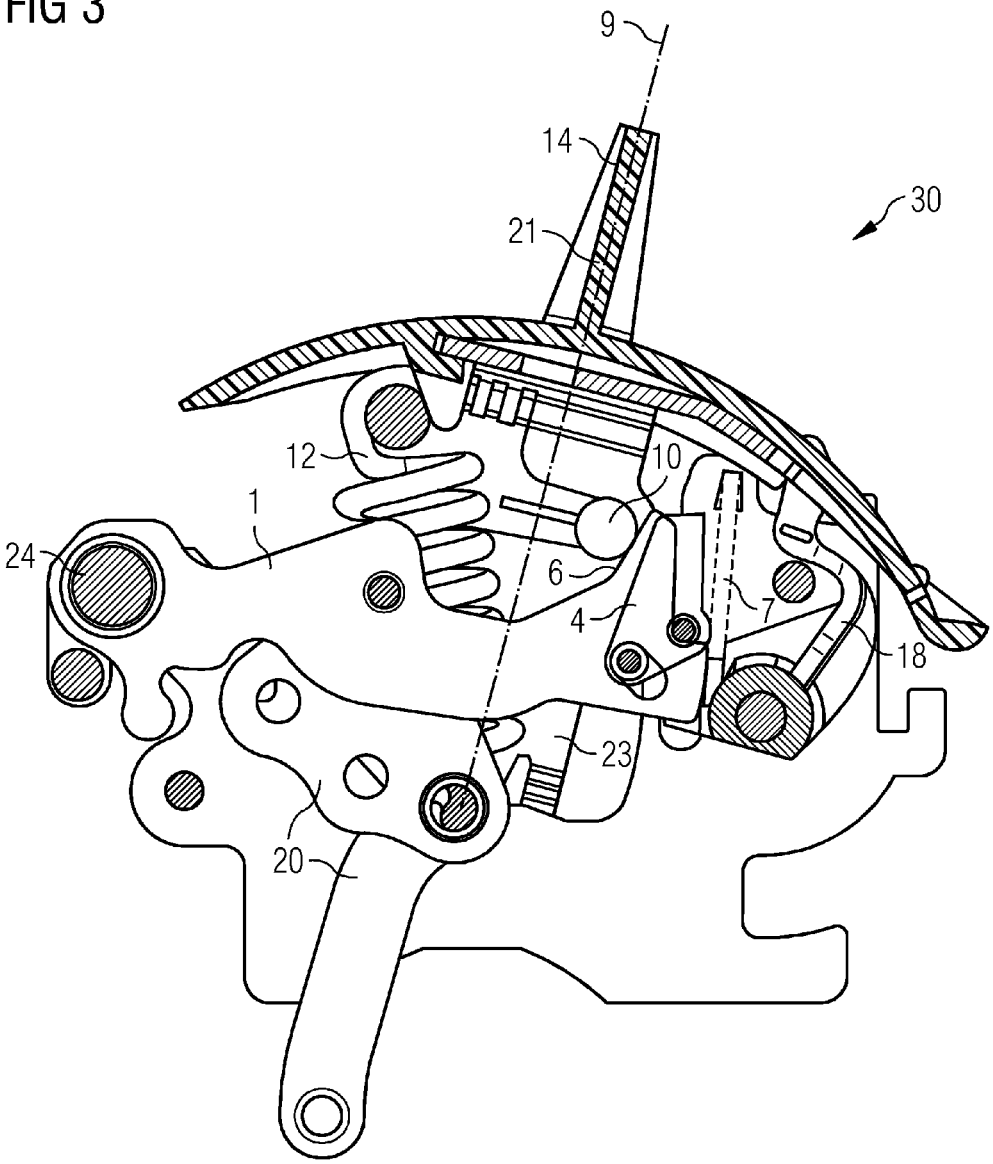
Figure 4:
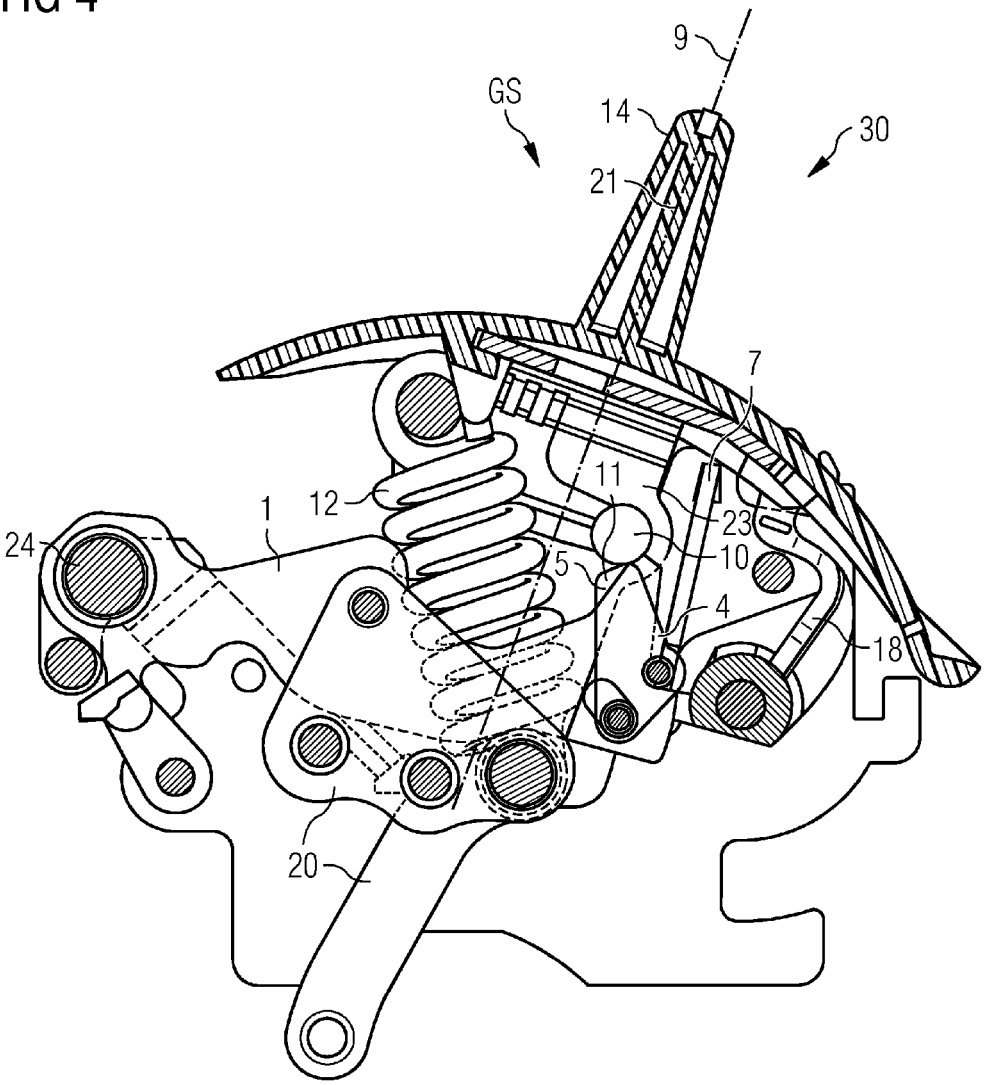
Figure 5:
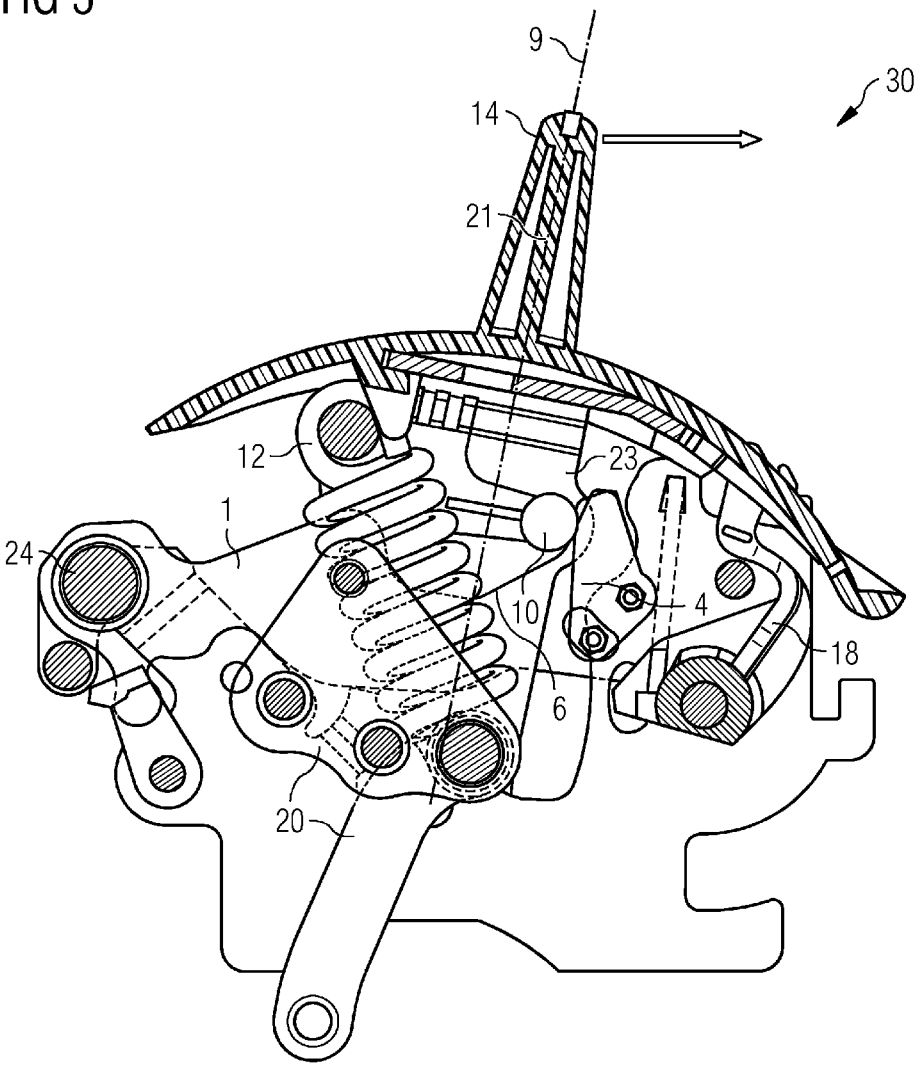

FIG. 3 shows the switching mechanism 30 according to FIG. 1 during the tensioning operation 9, i.e. during the movement of the operating lever 21 from the ON position to the OFF position. This movement corresponds to the tensioning operation 9 to transfer the latch 1 and the latching element 7 to the loaded position GS. During this tensioning operation 9 the tensioning roller 10 rolls along the clamping cam 6 of the latch 1 and moves it downward. The clamping cam 6, i.e. the contour of the latch 1 facing the tensioning roller 10, predetermines the degree of movement of the latch 1. This means that during the tensioning operation 9, operating lever 21 from "TRIP" to "RESET", the tensioning roller 10 moves upward on the clamping cam 6. In this case the rotary element 4 can be pushed back by the tensioning roller 10. This is shown in FIG. 5. If the tensioning roller 10 moves upward on the clamping cam 6 of the latch 1 the tensioning roller 10 presses the rotary element 4 below the line of the clamping cam 6. On reaching the OFF position ("RESET") of the operating lever 21 the rotary element 4 jumps back, under the effect of force exerted by the latching element 7, into its original position 11, see FIG. 4. In this original position 11 of the rotary element 4 the rotary element 4 overlaps the clamping cam 6 of the latch 1. Thus in this original position 11, also known as the neutral position, at least a part of the rotary element 4, in particular a keep-out area 13 of the rotary element 4, overlaps the clamping cam 6 of the latch 1. This original position 11 is necessarily reached by the pressure of the latching element 7 which is applied by the force element 8.

Figure 6:
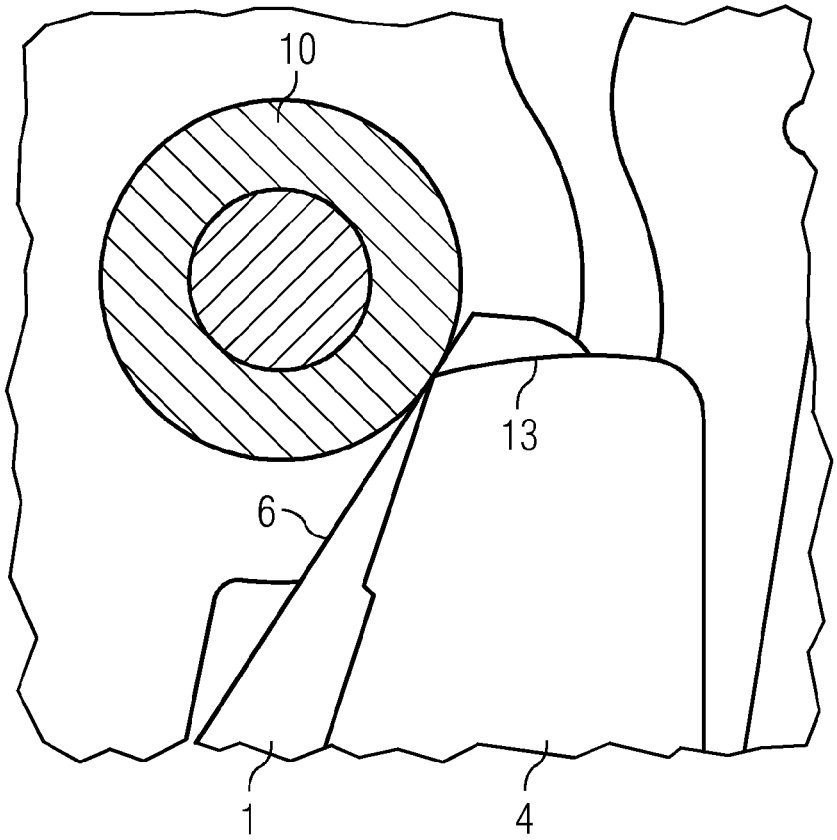
Figure 7:
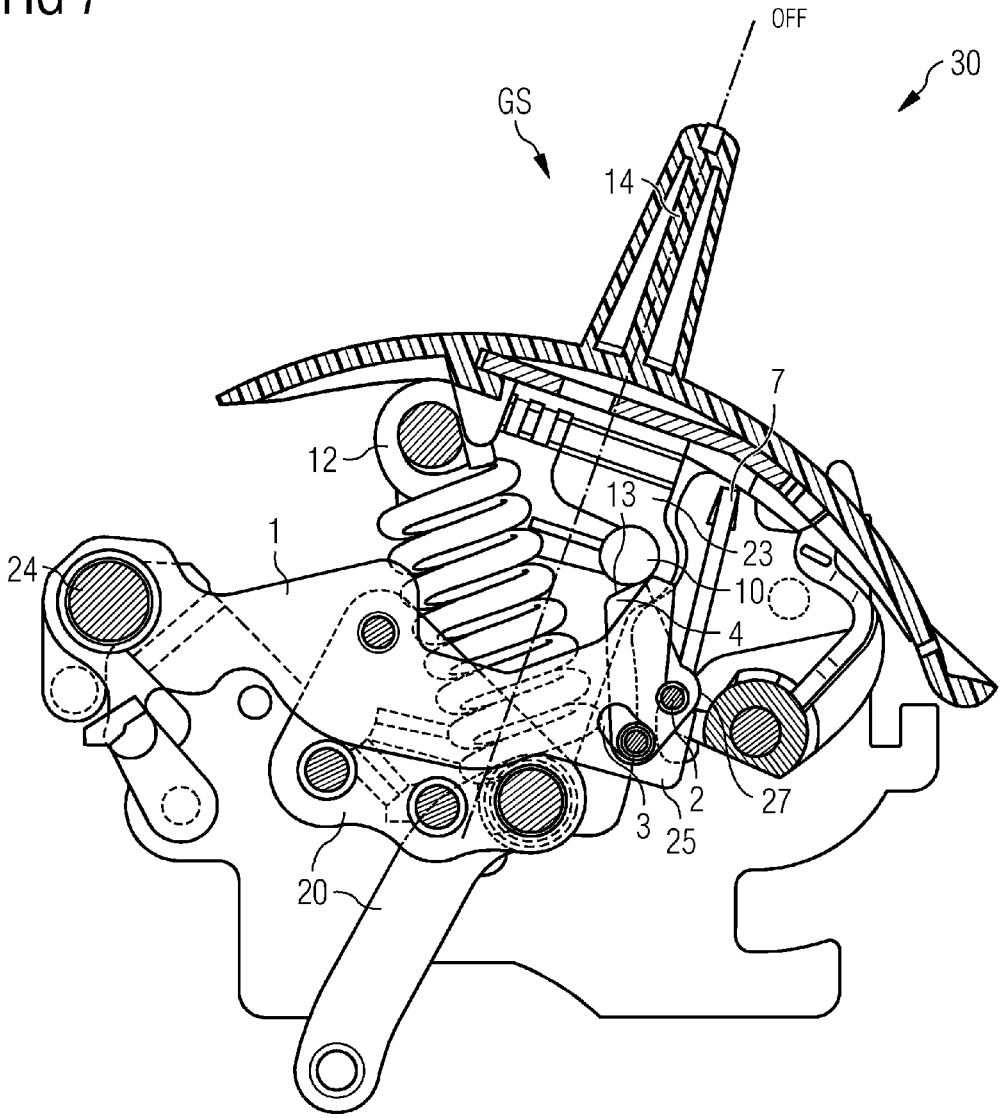

FIG. 6 schematically shows an enlarged illustration of the tensioning roller 10, the clamping cam 6, the latch 1 and the rotary element 4. The rotary element 4 has a function area, known as the keep-out area 13, at one end. If the tensioning roller 10 moves to the end of the clamping cam 6, the tensioning operation 9 is concluded. The tensioning roller 10 no longer contacts the rotary element 4, so that the latter, because of the pretensioning which the latching element 7 exerts on the rotary element 4, jumps back to its original position 11, in which at least the keep-out area 13 of the rotary element 4 overlaps the clamping cam 6 of the latch 1. This overlap position, i.e. the original position 11 of the rotary element 4, is shown in FIGS. 4 and 7.

After release of the grip 14 of the operating lever 21 the tensioning roller 10 moves back on the clamping cam 6, under the effect of the force of the tensioning element 12 on the latch 1, and stays on the keep-out area 13 of the rotary element 4 under pressure. The rotary element 4 or the keep-out area 13 of the rotary element 4 is designed such that the forces, i.e. the friction forces between the tensioning roller 10 and the keep-out area 13 of the rotary element 4 and those of the tensioning element 12, are in equilibrium, as a result of which the operating lever 21 stays in the OFF position and at the same time the loaded position GS is reached.

Figure 8:
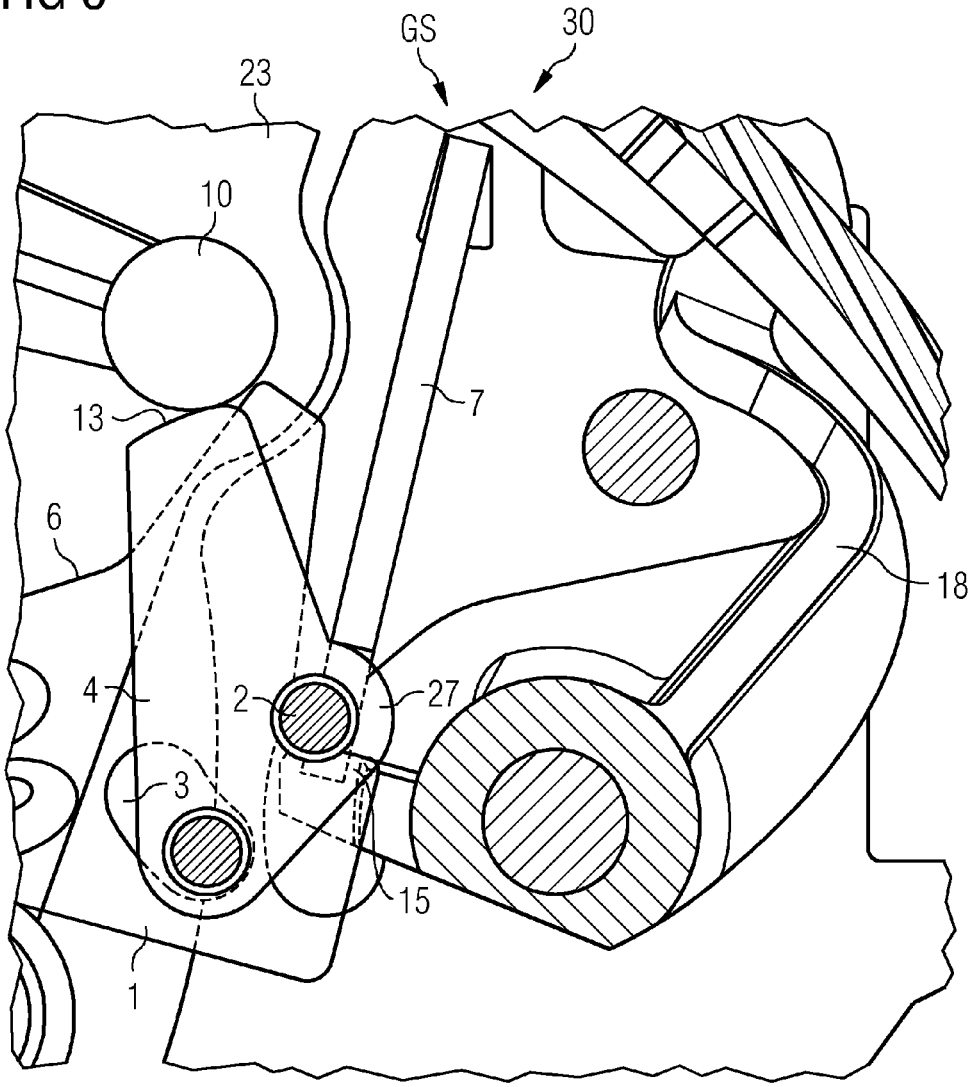
Figure 9:
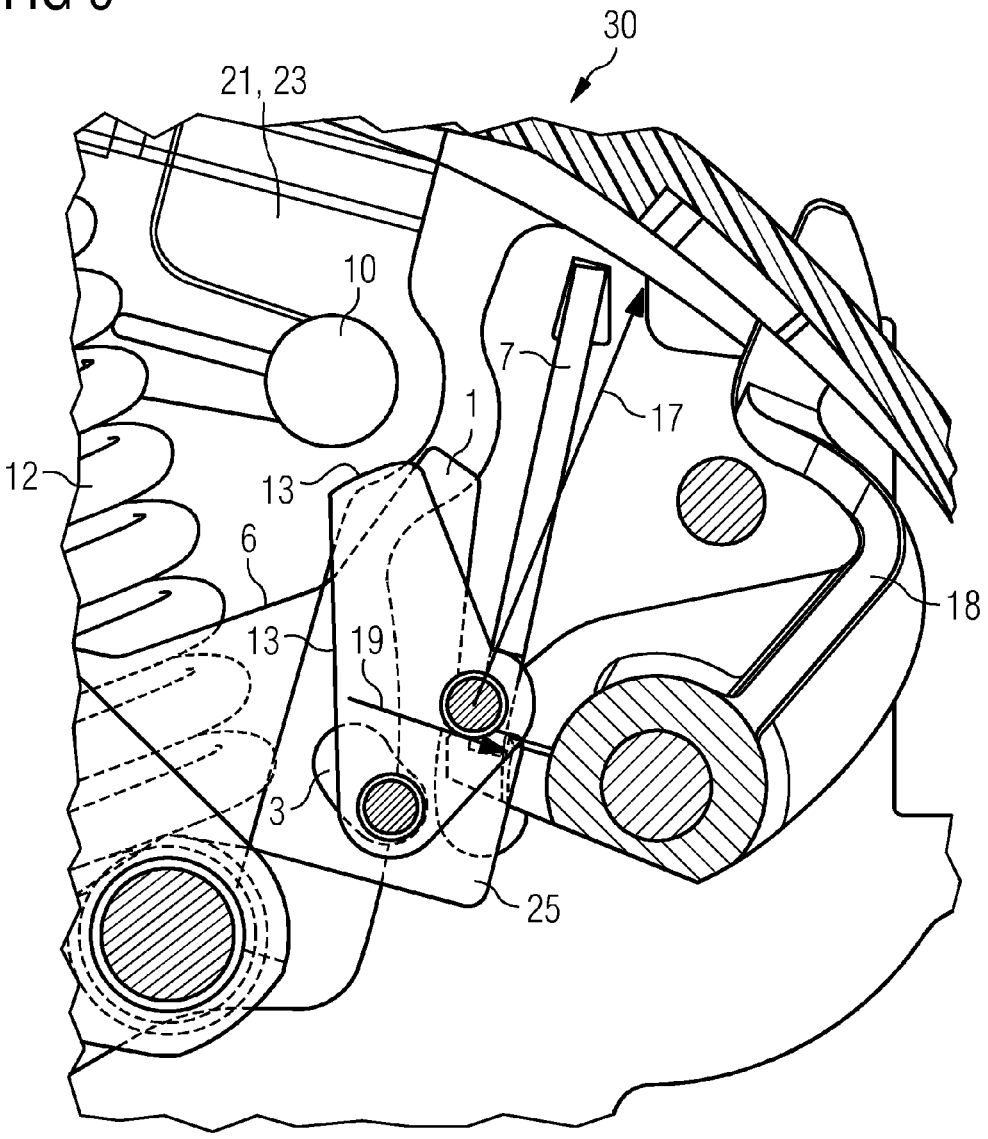

FIG. 8 schematically shows an enlarged illustration of the loaded position GS of the latch 1 or of the latching element 7. The latching element 7 has a recess, into which a part of the rotary element 4 is inserted. This means that the concentric contour 27 of the rotary element 4 slides along the latching element 7, until this concentric contour 27 reaches the recess of the latching element 7. After reaching the recess the rotary element 4 does not move in the direction of the latching element 7, but the latching element 7 moves in the direction of the rotary element 4. A gap 15 hereby arises between the latching element 7 and the tripping mechanism 18. This means that while the rotary element 4 or the keep-out area 13 of the rotary element 4 holds the tensioning roller 10 and thus the operating lever 21 in the OFF position, a gap 15 exists between the latching element 7 and the tripping mechanism 18. In this loaded position GS of the latch 1 and of the latching element 7 the tripping mechanism 18 can be actuated, without a tripping operation of the switching mechanism 30 being performed, as no pressure can be exerted by the tripping mechanism 18 on the latching element 7.

Thus the electrical switching device can be supplied by a manufacturer to a customer in such a loaded position GS of the latch 1 and of the latching element 7 as well as in the OFF position of the operating lever 21, wherein it is ensured that these positions are maintained even in the event of an undesired movement of the tripping mechanism 18. The tensioning roller 10 is held under pressure on the keep-out area 13 of the rotary element 4. The forces acting in the switching mechanism 30, in particular the friction force between the tensioning roller 10 and the keep-out area 13 as well as the force of the tensioning element 12 acting on the latch 1, are here in equilibrium.

If the operating lever 21 moves from the OFF position to the ON position, wherein the movement is triggered manually by a user of the electrical switching device, the tensioning roller 10, which is advantageously rotatably movably disposed on the terminal link 23 of the operating lever 21, lifts up from the keep-out area 13 of the rotary element 4, as a result of which the latch 1, under the effect of the tensioning element 12, is moved upward. This movement is restricted by the end 25 of the latch 1 touching the latching element 7.

Thus after the switch-on operation of the switching mechanism 30 or of the operating lever 21 forces of at least one pole unit of the electrical switching device and of the tensioning element 12 act on the latching element 7. These forces 17 generate a torque 16 in the bearing of the latching element 7, as a result of which a defined force 19 can be generated onto the tripping mechanism 18, wherein a tripping operation is then enabled. This means that after the tensioning roller 10 has been moved away from the rotary element 4, the latch 1 or the end 25 of the latch 1 latches onto the latching element 7, so that the latch 1 is further kept in a loaded position GS. If the tripping mechanism 18 is now actuated by a trip (not shown) of the electrical switching device, the tripping mechanism 18 can, because of the direct contact with the latching element 7, move the latter such that the latching of the latch 1 onto the latching element 7 is released, so that the electrical switching device can trip and the movable contact is separated by the switching mechanism 30 from the fixed contact of the electrical switching device.

Figure 10:
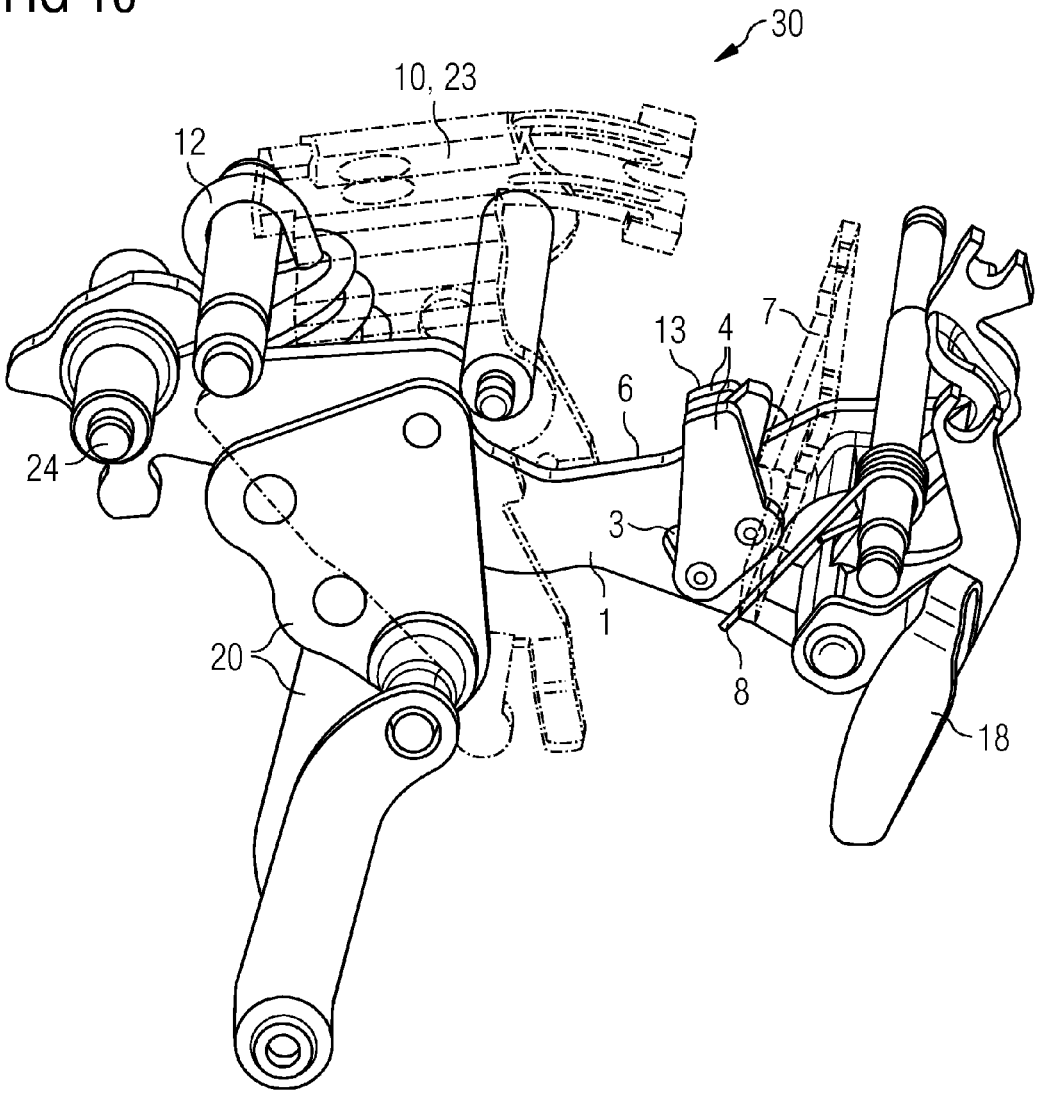

FIG. 10 schematically shows a perspective illustration of a switching mechanism 30 of an electrical switching device, in particular of a low-voltage circuit-breaker. The rotary element 4 is designed in two parts. This means that the rotary element 4 has a first base body which is disposed on a first side of the latch 1, and a second base body which is disposed on the other side of the latch 1. The two base bodies of the rotary element 4 are connected to one another by two bolts. In this case one bolt is mounted on a bearing 2 (not shown) on the latch 1 and the second bolt is guided in the sliding block guide 3 of the latch 1. Part of the rotary element 4 is inserted into a recess of the latching element 7. In this position of the rotary element 4 the part of the rotary element 4 with the keep-out area 13 overlaps the clamping cam 6 of the latch 1. The latching element 7 is, because of the spring force of the leg spring 8, pressed against the rotary element 4 so that a gap 15, see FIG. 8, arises between the rotary element 4 and the tripping mechanism 18.

Figure 11:
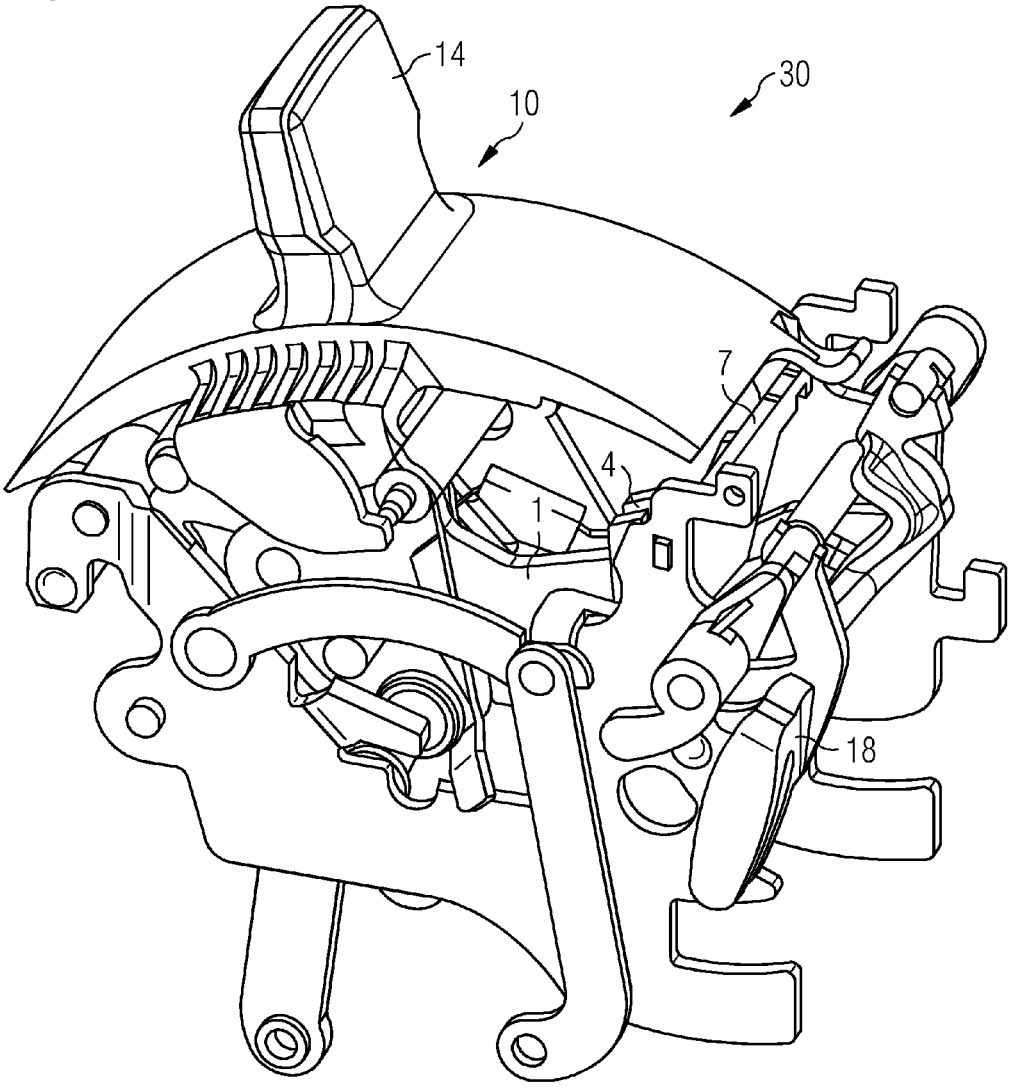

FIG. 11 shows the switching mechanism 30 according to FIG. 10 in another perspective illustration. As an addition to FIG. 10, the operating lever 21 is shown.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE CHARACTERS

1 Latch
2 Bearing
3 Sliding block guide
4 Rotary element
5 Overlap
6 Clamping cam
7 Latching element
8 Force element
9 Tensioning operation
10 Tensioning roller
11 Original position
12 Tensioning element
13 Keep-out area
14 Grip
15 Gap
16 Torque
17 Force of pole unit or tensioning element
18 Tripping mechanism
19 Force on tripping mechanism
20 Articulated mechanism
21 Operating lever
22 Recess
23 Terminal link
24 Latch spindle
25 End of the latch
26 Tripping shaft
27 Concentric contour on the rotary element
30 Switching mechanism
GS Loaded position of the latch/latching element
ON ON position of the operating lever
OFF OFF position of the operating lever

What is claimed is:

1. A switching mechanism for an electrical switching device, comprising:

an articulated mechanism, configured to move a movable contact;

an operating lever, configured to manually open and close the movable contact via the articulated mechanism, the operating lever including a grip and a terminal link, pivotable about a fixed bearing point;

a latch, rotatably mounted about a fixed latch spindle, including a clamping cam, an end of the latch cooperating with a latching element of the switching mechanism for latching and unlatching the latch on the latching element, the latch being in operative contact with the movable contact and configured to move the movable contact via the articulated mechanism;

a tensioning roller, drivable via the operating lever such that, in the event of a movement of the operating lever, the operating lever is in operative contact with the latch by rolling along the clamping cam of the latch;

a tensioning element, configured to tension the operating lever;

a tripping mechanism, configured to move the latching element by being brought into operative contact therewith;

a force element, disposed between the latching element and the tripping mechanism and configured to press apart the latching element and the tripping mechanism, wherein the force element is configured to exert a force on the latching element in a direction of an end of the latch, the latch including a bearing and a sliding block guide; and a rotary element, mounted on the bearing and guidable along the sliding block guide, wherein the rotary movement of the rotary element is restrictable by the sliding block guide, the rotary element being configured to be brought into operative contact firstly with the tensioning roller and secondly with the latching element and, upon conclusion of a tensioning operation of the operating lever, the rotary element being configured to hold the latch and the latching element in a loaded position, and the latch, the rotary element and the latching element being designed such that, during the tensioning operation of the operating lever, the rotary element is inserted into a recess of the latching element so that the latching element is movable in the direction of the end of the latch and away from the tripping mechanism so that, in the loaded position, a gap exists between the latching element and the tripping mechanism.

2. The switching mechanism of claim 1, wherein the rotary element includes a keep-out area and wherein, in the loaded position of the latch and of the latching element, the tensioning roller abuts the keep-out area.

3. The switching mechanism of claim 2, wherein the rotary element is designed and held on the bearing and the sliding block guide such that, upon conclusion of the tensioning operation of the operating lever, at least the keep-out area of the rotary element overlaps the clamping cam of the latch for the tensioning roller to abut the keep-out area.

4. The switching mechanism of claim 3, wherein the rotary element is in operative contact with the latching element such that upon conclusion of the tensioning operation of the operating lever, the latching element presses the rotary element into an original position, in which at least the keep-out area of the rotary element overlaps the clamping cam of the latch to abut the tensioning roller.

5. The switching mechanism of claim 2, wherein the operating lever is subject to a force of the tensioning element such that, upon conclusion of the tensioning operation of the operating lever and a subsequent release of the operating lever, the tensioning roller is rollable, under an effect of the tensioning element, along the clamping cam of the latch, until the tensioning roller abuts the keep-out area of the rotary element in equilibrium of the forces acting in the switching mechanism.

6. The switching mechanism of claim 1, wherein the bearing and the sliding block guide are disposed at least one of on and in the end facing the latching element.

7. The switching mechanism of claim 1, wherein, in the loaded position, the operating lever is in an OFF position.

8. The switching mechanism of claim 1, wherein the rotary element is movable on one side of the latch, parallel to the latch.

9. The switching mechanism of claim 1, wherein the rotary element includes a knife-edge bearing.

10. The switching mechanism of claim 1, wherein two rotary elements are provided, wherein a first rotary element is movably disposed on a first side of the latch and the second rotary element is disposed on the other side of the latch.

11. The switching mechanism of claim 1, wherein two latches are provided, between which the rotary element is movably disposed.

12. The switching mechanism of claim 1, wherein at least one of the tensioning element and the force element is designed as a spring element.

13. The switching mechanism of claim 1, wherein the rotary element is designed as a stamped part or as a plate bending part.

14. The switching mechanism of claim 1, wherein the articulated mechanism is designed as a toggle.

15. The switching mechanism of claim 1, wherein the latching element is a U-shaped plate.

16. The switching mechanism of claim 1, wherein the tripping mechanism includes a tripping shaft.

17. An electrical switching device, comprising:

a movable contact and a fixed contact;

a switching mechanism of claim 1, for connecting and for separating the movable contact and the fixed contact.

18. The switching mechanism of claim 1, wherein the switching mechanism is for a low-voltage circuit-breaker.

19. The electrical switching device of claim 17, wherein the electrical switching device is a low-voltage circuit-breaker.

* * * * *